US008962539B2

(12) United States Patent
Devlin et al.

(10) Patent No.: US 8,962,539 B2
(45) Date of Patent: Feb. 24, 2015

(54) FRICTION MODIFIERS FOR SLIDEWAY APPLICATIONS

(71) Applicant: Afton Chemical Corporation, Richmond, VA (US)

(72) Inventors: Mark T. Devlin, Richmond, VA (US); Helen T. Ryan, London (GB); Katie A. Hudson, Berkshire (GB)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 14/064,798

(22) Filed: Oct. 28, 2013

(65) Prior Publication Data

US 2014/0051616 A1 Feb. 20, 2014

Related U.S. Application Data

(63) Continuation of application No. 12/144,010, filed on Jun. 23, 2008, now abandoned.

(51) Int. Cl.

*C10M 129/00* (2006.01)
*C10M 133/28* (2006.01)
*C10M 141/10* (2006.01)

(52) U.S. Cl.

CPC ..... *C10M 141/10* (2013.01); *C10M 2203/1025* (2013.01); *C10M 2205/00* (2013.01); *C10M 2207/028* (2013.01); *C10M 2207/262* (2013.01); *C10M 2207/283* (2013.01); *C10M 2215/02* (2013.01); *C10M 2215/224* (2013.01); *C10M 2215/28* (2013.01); *C10M 2217/043* (2013.01); *C10M 2219/046* (2013.01); *C10M 2219/068* (2013.01); *C10M 2219/106* (2013.01); *C10M 2223/00* (2013.01); *C10M 2223/045* (2013.01); *C10M 2223/06* (2013.01); *C10N 2220/022* (2013.01); *C10N 2230/06* (2013.01); *C10N 2230/40* (2013.01); *C10N 2230/56* (2013.01); *C10N 2240/06* (2013.01); *C10N 2270/02* (2013.01)

USPC ..... 508/283; 508/486

(58) Field of Classification Search

USPC ..... 508/269, 387, 399, 433, 460, 545, 564, 508/283, 486

See application file for complete search history.

(56) References Cited

U.S. PATENT DOCUMENTS

| | | | | |
|---|---|---|---|---|
| 5,773,391 | A * | 6/1998 | Lawate et al. | 508/257 |
| 5,824,628 | A * | 10/1998 | Coates et al. | 508/433 |
| 5,891,786 | A * | 4/1999 | Srinivasan et al. | 508/188 |
| 2006/0264340 | A1 * | 11/2006 | Iyer et al. | 508/188 |
| 2007/0293406 | A1 * | 12/2007 | Henly et al. | 508/185 |

* cited by examiner

*Primary Examiner* — Taiwo Oladapo
(74) *Attorney, Agent, or Firm* — Brinks Gilson & Lione

(57) ABSTRACT

A slideway lubricating oil composition, additive concentrate, method of lubricating sliding parts. The lubricating oil includes a base oil; a metal-free friction modifier; and a metal-free, sulfur-free, phosphorus containing anti-wear/extreme pressure agent. The lubricating oil provides a lower coefficient of friction for non-metal sliding surfaces than for metal sliding surfaces.

4 Claims, No Drawings

FRICTION MODIFIERS FOR SLIDEWAY APPLICATIONS

CROSS REFERENCE TO RELATED APPLICATION

This application is a continuation of U.S. application Ser. No. 12/144,010, filed Jun. 23, 2008, the entire contents of which is hereby incorporated herein by reference.

TECHNICAL FIELD

The embodiments described herein relate to lubricant additives and use of such additives in lubricating oil formulations, and in particular to additive formulations used for slideway applications.

BACKGROUND AND SUMMARY

A slideway is a mechanical guide designed to provide a device with a track surface that is stable under load (i.e., minimal deflection) with a consistent finish for constant frictional forces, regardless of the rate of movement along the slideway. Slideways may be used in heavy machine tool applications as well as in various electronic components such as disk drives for computers. Other slideways may be included in automotive shifting mechanisms. In order to prevent stick-slip in slideway applications friction at low speed (hereinafter referred to as "static friction") must be lower than friction at high speed (hereinafter referred to as "dynamic friction"). Surface active agents (friction modifiers, anti-wear additives and extreme-pressure agents) are added to oils to reduce friction. The ability of surface active agents to reduce static friction on metal surfaces is well known. However, in many slideway applications, plastic surfaces are commonly used. Lubricant additives that are effective for metal surfaces may not be effective to reduce friction for plastic surfaces to levels suitable for protecting the plastic surfaces. Accordingly, a need exists for effective lubricant compositions and lubricant additive concentrates that are more suitable for reducing friction in slideways containing plastic components and/or plastic sliding surfaces.

In one embodiment disclosed herein is presented a slideway lubricating additive useful in lubricating oils for slideway applications having a non-metal surface to be lubricated. The lubricating additive includes a metal-free friction modifier; and a metal-free, sulfur-free, phosphorus containing anti-wear/extreme pressure agent. The composition provides a lower coefficient of friction for nonmetal sliding surfaces than for metal sliding surfaces.

In another embodiment is presented a lubricating oil composition containing the slideway lubricating additive. The lubricating oil compositions include a base oil a metal-free friction modifier; and a metal-free, sulfur-free, phosphorus containing anti-wear/extreme pressure agent. The composition provides a lower coefficient of friction for non-metal sliding surfaces than for metal sliding surfaces.

Another embodiment provides a method of lubricating a non-metal surface of a slideway component. The method includes applying a lubricant composition to the slideway component wherein the lubricant contains a base oil; and a metal-free friction modifier; a metal-free, sulfur-free, phosphorus containing anti-wear/extreme pressure agent. The lubricant composition provides a lower coefficient of friction for non-metal sliding surfaces than for metal sliding surfaces.

Since slideways commonly employ various non-metal surfaces, such as plastic and polymeric surfaces, lubricants suitable for friction reduction on non-metal surfaces are critical for successful lubrication of slideways. Lubricants and additive packages for lubricants described herein provide surface active agents that may have similar friction-reducing properties on metal surfaces but dramatically improve friction-reducing properties on non-metal surfaces.

It is to be understood that both the foregoing general description and the following detailed description are exemplary and explanatory only and are intended to provide further explanation of the embodiments disclosed and claimed.

DETAILED DESCRIPTION OF EMBODIMENTS

As used herein, the term "hydrocarbon soluble" means that the compound is substantially suspended or dissolved in a hydrocarbon material, as by reaction or complexation of a reactive metal compound with a hydrocarbon material. As used herein, "hydrocarbon" means any of a vast number of compounds containing carbon, hydrogen, and/or oxygen in various combinations.

The term "hydrocarbyl" refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The disclosure is directed to lubricants and additive concentrates for lubricant compositions that are effective for reducing friction in slideway applications incorporating non-metal surfaces. For the purposes of the disclosure, the term "non-metal" may include substantially non-porous components made of plastic, ceramic, polymeric, fiberglass, glass, and composite materials, but does not include components that are primarily made of metal, i.e., more than about 50 weight percent metal.

In particular, the disclosure provides in one embodiment a lubricant additive that includes metal-free friction modifiers that are more effective at reducing friction for non-metal surfaces than metal-containing friction modifiers. In another embodiment, the additive includes at least one amine-containing, metal-free friction modifier that is more effective for reducing friction on non-metal surfaces than amine-free metal-free friction modifiers. Yet another exemplary embodiment provides a lubricant additive that includes metal- and sulfur-free phosphorus compounds that are more effective for reducing friction on non-metal surfaces than metal-containing phosphorus/sulfur compounds and metal-free sulfur compounds.

Friction Modifier Components

A particularly suitable friction modifiers, according to the disclosure includes a metal-free, amine-containing friction modifier according to the following general formula:

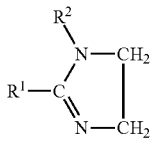

wherein $R^1$ is an alkyl or alkenyl group containing from about 10 to about 30 carbon atoms and $R^2$ is a hydroxyalkyl group containing from about 2 to about 4 carbon atoms. A particularly suitable metal-free, amine-containing friction modifier may be a hydroxyalkyl alkenyl glyoxalidine such as 2-(2-heptadec-1-enyl-4,5-dihydroimidazol-1-yl)ethanol available from Lonza of Allendale, N.J. under the trade name UNAMINE O. The amount of metal-free, amine-containing friction modifier in the lubricant composition may range from about 0.01 to about 1.0 percent by weight based on the total weight of the lubricant composition.

In addition to the aforementioned metal-free, amine containing friction modifiers, compositions of the present disclosure may include additional friction modifiers. Glycerides may be used alone or in combination with other friction modifiers. Suitable glycerides may include glycerides of the formula:

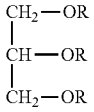

wherein each R is independently selected from the group consisting of H and C(O)R' where R' may be a saturated or an unsaturated alkyl group having from 3 to 23 carbon atoms. Examples of glycerides that may be used include glycerol monolaurate, glycerol monomyristate, glycerol monopalmitate, glycerol monostearate, and mono-glycerides derived from coconut acid, tallow acid, oleic acid, linoleic acid, and linolenic acids. Typical commercial monoglycerides contain substantial amounts of the corresponding diglycerides and triglycerides. Any ratio of mono- to di-glyceride may be used, however, it is preferred that from 30 to 70% of the available sites contain free hydroxyl groups (i.e., 30 to 70% of the total R groups of the glycerides represented by the above formula are hydrogen). A preferred glyceride is glycerol monooleate, which is generally a mixture of mono, di, and tri-glycerides derived from oleic acid, and glycerol. Suitable commercially-available glycerides include glycerol monooleates, which may generally contain approximately 50% to 60% free hydroxyl groups.

Anti-Wear/Extreme Pressure Agents

In addition to the foregoing friction modifier, lubricant compositions and additive concentrates according to the disclosure may also contain metal-free phosphorus anti-wear/extreme pressure agents. A particularly suitable anti-wear/extreme pressure agent is a metal-free, sulfur-free phosphorus compound represented by the following general formula:

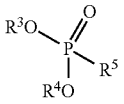

wherein each of $R^3$ and $R^4$ is an alkyl group having from about 1 to about 4 carbon atoms or hydrogen, provided that not both of $R^3$ and $R^4$ are hydrogen, and $R^5$ is an alkyl or alkenyl group having from about 6 to about 30 carbon atoms. Useful phosphonate esters include O,O-di-(primary alkyl)acyclic hydrocarbyl phosphonates in which the primary alkyl groups are the same or different each independently containing 1 to 4 carbon atoms and in which the acyclic hydrocarbyl group bonded to the phosphorus atom contains 12 to 24 carbon atoms and is a linear hydrocarbyl group free of acetylenic unsaturation. Exemplary compounds include O,O-dimethyl hydrocarbyl phosphonates, O,O-diethyl hydrocarbyl phosphonates, O,O-dipropyl hydrocarbyl phosphonates, O,O-dibutyl hydrocarbyl phosphonates, O,O-diiso-butyl hydrocarbyl phosphonates, and analogous compounds in which the two alkyl groups differ, such as, for example, O-ethyl-O-methyl hydrocarbyl phosphonates, O-butyl-O-propyl hydrocarbyl phosphonates, and O-butyl-O-isobutyl hydrocarbyl phosphonates, wherein in each case the hydrocarbyl group is linear and is saturated or contains one or more olefinic double bonds, each double bond preferably being an internal double bond. Suitable compounds include compounds in which both O,O-alkyl groups are identical to each other. Other suitable compounds include compounds in which the hydrocarbyl group bonded to the phosphorus atom contains 16 to 20 carbon atoms. A particularly suitable phosphonate ester compounds is dimethyloctadecyl phosphonate. Other examples of suitable phosphonate esters include, but are not limited to, dimethyl triacontylphosphonate, dimethyl triacontenylphosphonate, dimethyl eicosylphosphonate, dimethyl hexadecylphosphonate, dimethyl hexadecenylphosphonate, dimethyl tetracontenylphosphonate, dimethyl hexacontylphosphonate, dimethyl dodecylphosphonate, dimethyl dodecenylphosphonate and the like. Phosphonate esters are described, for example, in U.S. Pat. No. 4,158,633. The amount of anti-wear/extreme pressure agent in lubricant compositions according to the disclosure may range from about 0.01 to about 1.0 percent by weight based on a total weight of the lubricant composition.

Metallic Detergents

Certain metallic detergents may be included in the additive package of the for the slideway lubricant according to the disclosure. A suitable metallic detergent may include an oil-soluble neutral or overbased salt of alkali or alkaline earth metal with one or more of the following acidic substances (or mixtures thereof): (1) a sulfonic acid, (2) a carboxylic acid, (3) a salicylic acid, (4) an alkyl phenol, and (5) an organic phosphorus acid characterized by at least one direct carbon-to-phosphorus linkage. Such an organic phosphorus acid may include those prepared by the treatment of an olefin polymer (e.g., polyisobutylene having a molecular weight of about 1,000) with a phosphorizing agent such as phosphorus trichloride, phosphorus heptasulfide, phosphorus pentasulfide, phosphorus trichloride and sulfur, or white phosphorus and a sulfur halide.

Suitable salts may include neutral or overbased salts of magnesium, calcium, or zinc. As a further example, suitable salts may include magnesium sulfonate, calcium sulfonate, zinc sulfonate, magnesium phenate, calcium phenate, and/or zinc phenate. See, e.g., U.S. Pat. No. 6,482,778.

Examples of suitable metal-containing detergents include, but are not limited to, neutral and overbased salts such as a sodium sulfonate, a sodium carboxylate, a sodium salicylate, a sodium phenate, a lithium sulfonate, a lithium carboxylate, a lithium salicylate, a lithium phenate, a magnesium sulfonate, a magnesium carboxylate, a magnesium salicylate, a magnesium phenate, a calcium sulfonate, a calcium carboxylate, a calcium salicylate, a calcium phenate, a potassium sulfonate, a potassium carboxylate, a potassium salicylate, a potassium phenate, a zinc sulfonate, a zinc carboxylate, a zinc salicylate, and a zinc phenate. Further examples include a lithium, sodium, potassium, calcium, and magnesium salt of an aliphatic carboxylic acid and an aliphatic substituted cycloaliphatic carboxylic acid and many other similar alkali and alkaline earth metal salts of oil-soluble organic acids. A mixture of a neutral or an overbased salt of two or more different alkali and/or alkaline earth metals can be used. Likewise, a neutral and/or an overbased salt of mixtures of two or more different acids can also be used. Particularly suitable metal detergents useful in the slideway lubricants described herein may be selected from a calcium overbased sulfonate, a calcium overbased phenate and a calcium overbased sulfonate.

While any effective amount of the metallic detergents may be used to enhance the benefits of this invention, typically these effective amounts will range from about 0.01 to about 2.0 wt. % in the finished fluid, or as a further example, from about 0.1 to about 1.5 wt. % in the finished fluid.

Dispersant Components

Suitable dispersants may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,697,574 and 3,736,357; ashless succinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729. In one embodiment of the present disclosure, the dispersant may be a polyisobutyl-succinic anhydride dispersant. The amount of dispersant in the slideway lubricant composition may range from about 0.01 to about 2.0 weight percent based on the total weight of the lubricant composition.

Base Oils

Embodiments of the present disclosure may also include one or more base oils of lubricating viscosity. Base oils suitable for use in formulating the compositions, additives and concentrates described herein may be selected from any of the synthetic or natural oils or mixtures thereof. The synthetic base oils include alkyl esters of dicarboxylic acids, polyglycols and alcohols, poly-alpha-olefins, including polybutenes, alkyl benzenes, organic esters of phosphoric acids, polysilicone oils, and alkylene oxide polymers, interpolymers, copolymers and derivatives thereof where the terminal hydroxyl groups have been modified by esterification, etherification, and the like.

Natural base oils include animal oils and vegetable oils (e.g., castor oil, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils. The base oil typically has a viscosity of about 2.5 to about 15 cSt and preferably about 2.5 to about 11 cSt at 100° C.

In addition to the aforementioned components, embodiments of the present disclosure may further include one or more optional additive components, including, but not limited to, corrosion inhibitors, pour point depressants, antifoam agents, viscosity index improvers, and mixtures of two or more of the foregoing.

Corrosion Inhibitors

In some embodiments, copper corrosion inhibitors may constitute another class of additives suitable for inclusion in the compositions. Such compounds include thiazoles, triazoles and thiadiazoles. Examples of such compounds include benzotriazole, tolyltriazole, octyltriazole, decyltriazole, dodecyltriazole, 2-mercapto benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis (hydrocarbyldithio)-1,3,4-thiadiazoles. Suitable compounds include the 1,3,4-thiadiazoles, a number of which are available as articles of commerce, and also combinations of triazoles such as tolyltriazole with a 1,3,5-thiadiazole such as a 2,5-bis(alkyldithio)-1,3,4-thiadiazole. The 1,3,4-thiadiazoles are generally synthesized from hydrazine and carbon disulfide by known procedures. See, for example, U.S. Pat. Nos. 2,765,289; 2,749,311; 2,760,933; 2,850,453; 2,910,439; 3,663,561; and 3,840,549.

Rust or corrosion inhibitors are another type of inhibitor additive for use in embodiments of the present disclosure. Such materials include monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like. Another useful type of rust inhibitor may comprise alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable rust or corrosion inhibitors include ether amines; acid phosphates; amines; polyethoxylated compounds such as ethoxylated amines, ethoxylated phenols, and ethoxylated alcohols; imidazolines; aminosuccinic acids or derivatives thereof, and the like. Materials of these types are available as articles of commerce. Mixtures of such rust or corrosion inhibitors can be used. The amount of corrosion inhibitor in the transmission fluid formulations described herein may range from about 0.01 to about 2.0 wt % based on the total weight of the formulation.

Demulsifiers

A small amount of a demulsifying component may be used. A preferred demulsifying component is described in EP 330, 522. Such demulsifying component may be obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour Point Depressants

Pour point depressants, otherwise known as lube oil flow improvers, lower the minimum temperature at which the fluid will flow or can be poured. Such additives are well known.

Typical of those additives which improve the low temperature fluidity of the fluid are $C_8$ to $C_{18}$ dialkyl fumarate/vinyl acetate copolymers, polyalkylmethacrylates, polystyrene-succinate esters, and the like.

Viscosity Modifiers

Viscosity modifiers (VM) function to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

The additives are typically blended into the base oil in an amount that enables that additive to provide its desired function. Representative effective amounts of additives, when used in lubricant formulations, are listed in Table 1 below. All the values listed are stated as weight percent active ingredient. These values are provided merely as exemplary ranges, and are not intended to limit the embodiments in any way.

TABLE 1

| Component | Wt. % (Broad) | Wt. % (Typical) |
|---|---|---|
| Dispersant | 0.5-10.0 | 1.0-5.0 |
| Metal detergents | 0.1-15.0 | 0.2-2.0 |
| Corrosion Inhibitor | 0-5.0 | 0-2.0 |
| Anti-wear/extreme pressure agents | 0.01-1.0 | 0.1-0.6 |
| Metal-free amine-containing friction modifier | 0.01-1.0 | 0.1-0.6 |
| Antifoaming agent | 0-5.0 | 0.001-0.15 |
| Supplemental friction modifiers | 0-2.0 | 0.1-1.0 |
| Pour point depressant | 0.01-5.0 | 0.01-1.5 |
| Viscosity modifier | 0.01-20.00 | 0.25-10.0 |
| Base oil | Balance | Balance |
| Total | 100 | 100 |

The additives may be added directly to the lubricating oil composition. In one embodiment, however, they are diluted with a substantially inert, normally liquid organic diluent such as mineral oil, synthetic oil, naphtha, alkylated (e.g. $C_{10}$ to $C_{13}$ alkyl) benzene, toluene or xylene to form an additive concentrate.

The following example is given for the purpose of exemplifying aspects of the embodiments and is not intended to limit the embodiments in any way.

Example 1

Boundary friction coefficients were measured using a PCS Instruments High Frequency Reciprocating Rig (HFRR). Friction coefficients were measured at 130° C. between a SAE 52100 metal ball and either a SAE 52100 metal disk or a 1 cm by 1 cm piece of plastic slideway material. The ball was oscillated across the materials at a frequency of 20 Hz over a 1 mm path, with an applied load of 4.0 N.

All fluids in Table I were blended into a Group II base oil with a 100° C. kinematic viscosity of ~4.0 cSt. The friction modifiers, anti-wear/extreme pressure agents and detergents were added to the base oil at a concentration of 0.40 weight percent. The dispersants were added to the base oil at a concentration of 3.0 weight percent.

Table I shows the friction data for a series of fluids containing 1) a friction modifier, 2) an anti-wear/extreme pressure agent 3) a detergent and 4) a dispersant. The friction modifiers used in these fluids include: a metal-free, amine-containing friction modifier (UNAMINE-O), a metal-free, amine-free friction modifier (glycerol monooleate-GMO) and a metal-containing friction modifier (molybdenum dithiocarbamate-MoDTC). The anti-wear/extreme pressure agents used in these fluids include: a metal and sulfur-free phosphorus compound (dimethyloctylphosphonate-DMOP), a metal and phosphorus-free sulfur compound (thiadiazole) and a metal, sulfur and phosphorus containing anti-wear agent (zinc dithiodiphosphate-ZDDP). The detergents used in these fluids include: a calcium overbased sulfonate, a calcium overbased phenate and a calcium overbased sulfonate. The dispersants used in these fluids include: a succinimide dispersant, a Mannich dispersant and a functionalized olefin copolymer.

Table I shows the 130° C. boundary friction coefficients for all fluids measured on metal and on plastic. In order to determine the effect of each additive on friction a standard statistical technique is used in which the "grand average" of the friction coefficients for each additive is determined. For example, in Table I, the first ten fluids contain UNAMINE O (U-O). The average friction coefficient on metal for these first ten fluids is 0.115 and the average friction coefficient on plastic is 0.069. Fluids 11 through 22 contain glycerol monooleate (GMO) and the average friction coefficient on metal for these fluids is 0.115 and the average friction coefficient on plastic is 0.091. Fluids 23 through 34 contain molybdenum dithiocarbamate (Mo-DTC) and the average friction coefficient on metal for these fluids is 0.122 and the average friction coefficient on plastic is 0.113. The "grand averages" for each additive on metal and plastic are shown in Table II.

TABLE I

Boundary Friction Coefficients Measured on Metal and Plastic

| Sample No. | Friction Modifier | Anti-wear/EP Agent | Detergent | Dispersant | Friction Coefficient On steel | Friction Coefficient On plastic |
|---|---|---|---|---|---|---|
| 1 | U—O | DMOP | Sulfonate | OCP | 0.113 | 0.069 |
| 2 | U—O | DMOP | Salicylate | Mannich | 0.114 | 0.063 |
| 3 | U—O | DMOP | Phenate | Succinimide | 0.106 | 0.077 |
| 4 | U—O | TDZ | Phenate | OCP | 0.119 | 0.057 |
| 5 | U—O | TDZ | Sulfonate | Mannich | 0.127 | 0.065 |
| 6 | U—O | TDZ | Salicylate | Succinimide | 0.123 | 0.060 |
| 7 | U—O | ZDDP | Salicylate | OCP | 0.121 | 0.074 |

TABLE I-continued

Boundary Friction Coefficients Measured on Metal and Plastic

| Sample No. | Friction Modifier | Anti-wear/EP Agent | Detergent | Dispersant | Friction Coefficient On steel | Friction Coefficient On plastic |
|---|---|---|---|---|---|---|
| 8 | U—O | ZDDP | Phenate | Mannich | 0.095 | 0.072 |
| 9 | U—O | ZDDP | Phenate | Succinimide | 0.117 | 0.063 |
| 10 | U—O | ZDDP | Sulfonate | Succinimide | 0.115 | 0.091 |
| 11 | GMO | DMOP | Salicylate | OCP | 0.128 | 0.056 |
| 12 | GMO | DMOP | Sulfonate | Mannich | 0.125 | 0.089 |
| 13 | GMO | DMOP | Phenate | Succinimide | 0.113 | 0.091 |
| 14 | GMO | DMOP | Salicylate | Succinimide | 0.132 | 0.093 |
| 15 | GMO | TDZ | Sulfonate | OCP | 0.125 | 0.140 |
| 16 | GMO | TDZ | Salicylate | Mannich | 0.120 | 0.090 |
| 17 | GMO | TDZ | Phenate | Succinimide | 0.127 | 0.082 |
| 18 | GMO | ZDDP | Phenate | OCP | 0.098 | 0.090 |
| 19 | GMO | ZDDP | Phenate | Mannich | 0.120 | 0.067 |
| 20 | GMO | ZDDP | Salicylate | Mannich | 0.101 | 0.079 |
| 21 | GMO | ZDDP | Sulfonate | Succinimide | 0.099 | 0.122 |
| 22 | GMO | ZDDP | Salicylate | Succinimide | 0.111 | 0.091 |
| 23 | MoDTC | DMOP | Phenate | OCP | 0.103 | 0.072 |
| 24 | MoDTC | DMOP | Phenate | Mannich | 0.111 | 0.091 |
| 25 | MoDTC | DMOP | Salicylate | Mannich | 0.107 | 0.089 |
| 26 | MoDTC | DMOP | Salicylate | Succinimide | 0.151 | 0.080 |
| 27 | MoDTC | TDZ | Salicylate | OCP | 0.118 | 0.161 |
| 28 | MoDTC | TDZ | Sulfonate | OCP | 0.118 | 0.109 |
| 29 | MoDTC | TDZ | Phenate | Mannich | 0.129 | 0.104 |
| 30 | MoDTC | TDZ | Phenate | Succinimide | 0.146 | 0.095 |
| 31 | MoDTC | ZDDP | Sulfonate | OCP | 0.112 | 0.117 |
| 32 | MoDTC | ZDDP | Sulfonate | Mannich | 0.097 | 0.129 |
| 33 | MoDTC | ZDDP | Salicylate | Mannich | 0.134 | 0.162 |
| 34 | MoDTC | ZDDP | Phenate | Succinimide | 0.143 | 0.145 |

TABLE 2

Grand Average Friction Coefficients For Each Component

| Component | Friction Coefficient on Steel | Friction Coefficient on Plastic |
|---|---|---|
| UNAMINE-O | 0.115 | 0.069 |
| GMO | 0.115 | 0.091 |
| MoDTC | 0.122 | 0.113 |
| DMOP | 0.119 | 0.079 |
| Thiadiazole | 0.125 | 0.096 |
| ZDDP | 0.111 | 0.100 |
| Calcium sulfonate | 0.115 | 0.103 |
| Calcium phenate | 0.116 | 0.085 |
| Calcium salicylate | 0.122 | 0.092 |
| Functionalized OCP | 0.116 | 0.094 |
| Succinimide | 0.124 | 0.091 |
| Mannich | 0.114 | 0.092 |

Table II shows that on metal the friction coefficients for all the friction modifiers are within 6% of one another (100*(0.122-0.115)/0.122). However, on plastic, the average friction coefficient for fluids containing GMO is 19% lower (100*(0.113-0.091)/0.113) than the average friction coefficient for fluids containing MoDTC. In addition, the average friction coefficient for fluids containing U-O is 39% lower (100*(0.113-0.069)/0.113) than the average friction coefficient for fluids containing MoDTC.

Table II also shows that for antiwear agents the average friction coefficients on metal for fluids containing thiadiazole (0.125) or DMOP (0.119) are greater than the average friction coefficient for fluids containing ZDDP (0.111). However, on plastic the average friction coefficient for fluids containing DMOP is 21% lower (100*(0.100-0.079)/0.100) than the average friction coefficient for fluids containing ZDDP. In addition, on plastic the average friction coefficient for fluids containing DMOP is 18% lower (100*(0.096-0.079)/0.096) than the average friction coefficient for fluids containing thiadiazole.

Example 2

In another series of tests, boundary friction coefficients were measured as in Example 1 at 130° C. between a SAE 52100 metal ball and a 1 cm by 1 cm piece of plastic slideway material. In test fluid contained a base oil having only 0.2 weight percent of each of the friction modifiers or anti-wear agents listed in example 1. The results are given in the following Table 3.

TABLE 3

| Weight percent in base oil | Additive | 130° C. Friction Coefficient on plastic |
|---|---|---|
| 0.20 | MoDTC | 0.268 |
| 0.20 | ZDDP | 0.202 |
| 0.20 | Thiadiazole | 0.142 |
| 0.20 | GMO | 0.106 |
| 0.20 | DMOP | 0.094 |
| 0.20 | U-O | 0.072 |

According to the foregoing examples, the following observations may be articulated:

1) metal-free friction modifiers (thiadiazole, GMO, DMOP and U-O) reduce friction on plastic better than metal-containing friction modifiers.
2) amine-containing metal-free friction modifiers (U-O) reduce friction better than amine-free metal-free friction modifiers.
3) metal- and sulfur-free phosphorus compounds (DMOP) reduce friction on plastic better than metal-containing phosphorus/sulfur compounds and metal-free sulfur compounds.

It is expected that a lubricant composition containing an amine-containing metal-free friction modifier and a metal- and sulfur-free phosphorus compound will provide superior boundary friction characteristics on plastic materials.

At numerous places throughout this specification, reference has been made to a number of U.S. Patents. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A method of lubricating a non-metal surface of a slideway component, the method comprising applying a lubricant composition to the slideway component, the lubricant composition comprising: a base oil; a metal-free friction modifier selected from the group consisting of glyoxalidines, glycerides, and combinations thereof, wherein the glycerides are of the formula:

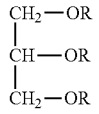

wherein each R is independently selected from the group consisting of H and C(O)R' wherein R' may be a saturated or an unsaturated alkyl group having from 3 to 23 carbon atoms; a metal-free and sulfur-free, phosphorus containing anti-wear/extreme pressure agent; wherein the composition provides a lower coefficient of friction for non-metal sliding surfaces than for metal sliding surfaces, and wherein the lubricating composition is free of or essentially free of metal-containing friction modifiers.

2. The method of claim 1, wherein the anti-wear/extreme pressure agent comprises dimethyl octadecyl phosphonate.

3. The method of claim 1, wherein the lubricant composition includes a detergent selected from the group consisting of a calcium overbased sulfonate, a calcium overbased phenate, and a calcium overbased salicylate.

4. The method of claim 1, wherein the lubricant composition includes a dispersant selected from the group consisting of a succinimide dispersant, a Mannich dispersant, and a functionalized olefin copolymer dispersant.

* * * * *